US006588614B2

(12) United States Patent
Neuner

(10) Patent No.: US 6,588,614 B2
(45) **Date of Patent: *Jul. 8, 2003**

(54) SNAP-ON PLASTIC NECK FOR CONTAINERS

(75) Inventor: Charles P. Neuner, Amityville, NY (US)

(73) Assignee: Color Access, Inc., Melville, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/997,847

(22) Filed: Nov. 30, 2001

(65) Prior Publication Data

US 2002/0079280 A1 Jun. 27, 2002

Related U.S. Application Data

(63) Continuation-in-part of application No. 09/585,140, filed on Jun. 1, 2000, now Pat. No. 6,341,706.

(51) Int. Cl.[7] ..... B65D 1/02
(52) U.S. Cl. ..... 215/40; 222/570
(58) Field of Search ..... 215/40, 228, 43, 215/44, 271–275, 224, 247, 252, 344, 345, 316; 222/567, 569, 570, 573; 53/476, 484, 488

(56) References Cited

U.S. PATENT DOCUMENTS

| | | | | |
|---|---|---|---|---|
| 3,659,736 | A | 5/1972 | Riggs | 215/40 |
| 3,840,137 | A | 10/1974 | Faulstich | 215/256 |
| 4,037,746 | A | 7/1977 | Ver Hage | 215/31 |
| 4,129,236 | A | 12/1978 | Wrycraft et al. | 222/570 |
| 4,582,207 | A | 4/1986 | Howard et al. | 215/247 |
| 4,773,553 | A | 9/1988 | Van Brocklin | 215/272 |
| 5,123,555 | A | 6/1992 | Luch et al. | 215/256 |
| 5,176,278 | A | 1/1993 | Quarberg | 220/256 |
| 5,562,219 | A | 10/1996 | de Pous et al. | 215/274 |
| 5,615,788 | A | 4/1997 | Larguia | 215/274 |
| 5,662,233 | A | 9/1997 | Reid | 215/273 |
| 5,857,579 | A | 1/1999 | Finneran | 215/252 |
| 5,938,082 | A | 8/1999 | Foster et al. | 222/153.09 |
| 6,253,941 | B1 | 7/2001 | Van Brocklin et al. | 215/274 |
| 6,341,706 | B1 * | 1/2002 | Neuner | 215/40 |

* cited by examiner

*Primary Examiner*—Lee Young
*Assistant Examiner*—Lien Ngo
(74) *Attorney, Agent, or Firm*—Martin W. Haerter, Esq.

(57) ABSTRACT

A container made from a vial-like mass produced bottle with a structurally detailed, separately molded plastic neck mounted securely thereon, and a simple method for securely mounting the plastic neck to the bottle is disclosed. The open end of the bottle has a neck with a flange forming an annular shoulder. A plastic neck insert is provided that has a threaded neck opposite a resilient sleeve. The resilient sleeve is adapted to expand to receive the flange in a snap fit type engagement. An aluminum ferrule is press fit over the resilient sleeve of the plastic neck insert to lock the plastic neck insert onto the flange. The ferrule has an upwardly directed edge that engages a downwardly directed edge of the sleeve in interference fit to lock the ferrule onto the sleeve. An elastic seal is provided between the plastic neck insert and the bottle to ensure that the connection of the two components is airtight.

27 Claims, 4 Drawing Sheets

SNAP-ON PLASTIC NECK FOR CONTAINERS

CROSS REFERENCE TO RELATED APPLICATIONS

This is a continuation-in-part of commonly assigned application Ser. No. 09/585,140, filed Jun. 1, 2000 now U.S. Pat. No. 6,341,706, which was allowed on Sep. 28, 2001, and which is incorporated by reference herein, in its entirety.

BACKGROUND OF THE INVENTION

1. Field of the Invention

This invention relates to an improved device for mounting a plastic neck on economical containers made of a metal, plastic, paper or wax. In particular, the invention relates to a plastic neck with a resiliently deformable end that is adapted to snap onto a pre-manufactured vial-like bottle and a substantially non-deformable ferrule secured over the deformable end of the neck to retain it on the bottle.

2. Description of the Prior Art

For the storage of a certain products, containers made of metal, plastic, paper or wax may be preferred over containers made from glass or other materials. Metal, plastic, paper or wax containers may be favored for their esthetic appeal or for their low cost in comparison to, for example, glass. Metal, plastic, paper or wax containers can be produced in a variety of esthetically appealing colors, shapes and designs. As materials for making containers, metal offers, for example, excellent esthetic appeal, plastic offers, for example, high economy and paper and wax offer, for example, biodegradability.

However, manufacture of some metal, plastic, paper or wax bottles with certain desirable structural details, such as, for example, precise tolerances, detailed or sharp geometry and fine threads, may not be possible at low cost. Such structural details yield packages that are more attractive and perform better (e.g., open and close more conveniently and seal the contents more tightly against contamination and/or deterioration) than less detailed structure. These structural details are generally associated with higher quality and higher cost packaging, i.e., 'high-end' packaging, such as, for example, packaging for pharmaceuticals and high-end cosmetics. As a particular example, these structural details are desirable for high-end mascara packages to securely attach a typical wiper and a typical combination applicator brush and closure cap.

Vial-like metal, plastic, paper or wax bottles may be mass-produced at a low cost, albeit without finely detailed structure. A typical metal vial-like bottle is made, for example, by well known methods, such as, stamping, deep-drawing, hydro-forming, bulging, roll-forming, sintering, casting, etc. A typical low cost plastic vial-like bottle is made, for example, by well known methods, such as, blow molding, injection molding, roto-molding, extrusion blow molding, etc. Paper or wax bottles may be similarly formed. The techniques for mass producing vial-like bottles are well known.

While offering at least the foregoing advantages, mass-produced vial-like bottles have several disadvantages. For example, the precise tolerances, detailed or sharp geometry, or the fine threads preferred for esthetically and functionally superior packaging may not be provided to these bottles at a low cost. Although low cost vial-like bottles may be readily produced with a neck ring or flange on the neck adjacent to the bottle opening, dimensional tolerances for the bottleneck and flange may not be as precise as desired for what is considered 'high-end' packaging.

Certain plastic materials can be molded in a minimum number of manufacturing steps to significantly precise tolerances at a low cost. Thus, these plastic materials are ideal for forming, for example, a bottle with a finely threaded neck. However, plastic material that is well suited to forming detailed neck structures may lack the esthetic appeal of metal or the economy of certain other plastic materials more suitable for making container bodies.

An ideal container would offer the advantages of a metal or low cost plastic container body combined with the advantages of a highly defined plastic neck. Containers are known that provide the benefits of a highly defined plastic neck to mass-produced container bodies, but these generally involve relatively complex and costly manufacturing steps, such as, for example, adhering, welding or crimping. These attachment methods can slow production and add significantly to per unit cost of producing a two part container.

U.S. Pat. No. 4,773,553 to Van Brocklin discloses dispenser including a plastic sleeve for mounting on a flanged container. The plastic sleeve has spaced tabs that are initially radially outwardly positioned, but that can be deformed radially inwardly beneath the flange of the container by a mounting cup (a ferrule). A drawback with this arrangement is that the mounting cup must have sufficient strength to deform the tabs and hold them securely in the deformed position. Also, variations in the degree and direction of deformation of the tabs may require the provision of tabs or a cap having dimensions and strength sufficiently large to compensate for such variations. These considerations would in turn yield a plastic sleeve and/or a cup with dimensions (e.g., thickness, length, etc.) that are undesirably large, particularly for a relatively small package, such as, for example, a mascara package. Also, the mounting cup has a sharp lower edge that could cause discomfort or even injury to the user, a drawback for a consumer oriented package.

U.S. Pat. No. 5,562,219 to de Pous et al. discloses a device for attaching a dispenser member to a receptacle. The device includes an attaching ring, a bottom portion of which is provided with snap-fastening tabs for fixing the ring to the neck of the receptacle. A hoop is provided to prevent tabs from splaying apart, thus, it is said, ensuring that the ring will remain fixed or attached. The hoop can be provided with one or more projections on the inside face, which may be defined by the convex side of an indentation formed in the wall of the hoop. A drawback of this arrangement is that the indentation in the wall of the hoop may undesirably impact the external appearance of a finished package. Another drawback of this arrangement is that the hoop appears to rely on the frictional interference fit between the projections and the plastic ring, but is not otherwise securely locked to the ring.

Also known are containers having a plastic cap attached to a bottle by a collar. For example, U.S. Pat. No. 5,857,579 discloses a plastic cap with a skirt that is snap fit onto the open end of a bottle. A collar, which may be made of a more rigid material than the cap, is placed over the skirt to enhance the points of contact between the cap and the container. However, the cap is applied directly to the container, and a neck with detailed or sharp geometry, fine threads, close dimensional tolerances or resilient sealing surfaces that would support, for example, the cap and applicator of a mascara package, is not disclosed.

Thus, there is need for a two part container made from a mass produced vial-like metal or plastic bottle with a highly defined plastic neck attached securely by simple, cost effective means, such that the container is air tight.

BRIEF SUMMARY OF THE INVENTION

The present invention is directed to an assembly for mounting a finely detailed plastic neck on a vial-like mass produced bottle made from metal, plastic, paper or wax. The invention is also directed to a simple, low cost method for securely mounting the plastic neck to the bottle. The bottle has an open end or neck with a flange or a downwardly directed annularly arranged shoulder. A plastic neck member is provided that has a first threaded end for receiving a cap, or a cap and dispenser combination. A second resilient end of the neck member has a sleeve adapted and dimensioned to snap fit onto the open end of the glass bottle by engaging the annular shoulder. The sleeve has a downwardly directed edge in an outer surface. A ferrule, preferably of metal, is press fit over the sleeve to lock the neck member onto the bottle. The ferrule has an upwardly directed edge that engages the downwardly directed edge of the sleeve. The upwardly directed edge is preferably provided by folding a lower edge of the ferrule inwardly and upwardly to form an inner rim. During assembly, the ferrule is forced over the neck member until the inner rim snaps in below the downwardly directed edge of the neck member, thus locking the ferrule onto the neck member. A seal provided between the neck member and the bottle ensures that the connection of the plastic neck member to the bottle is airtight.

DETAILED DESCRIPTION OF THE INVENTION

Figure 1:
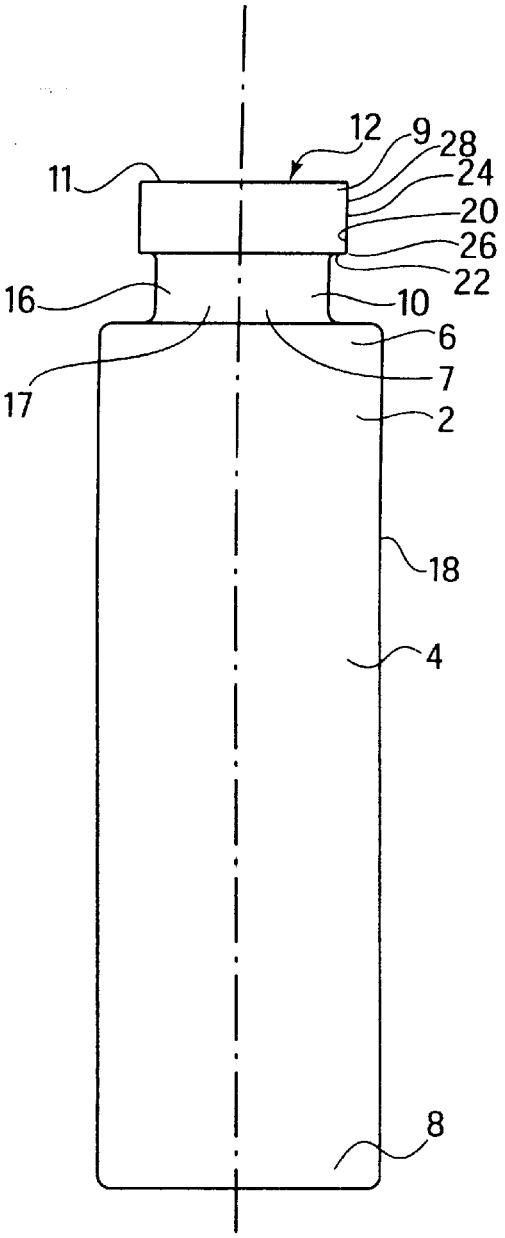
FIG. 1 (Prior Art)
FIG. 1 is a side elevation of a prior art vial-like bottle with a flanged neck.
Figure 2:
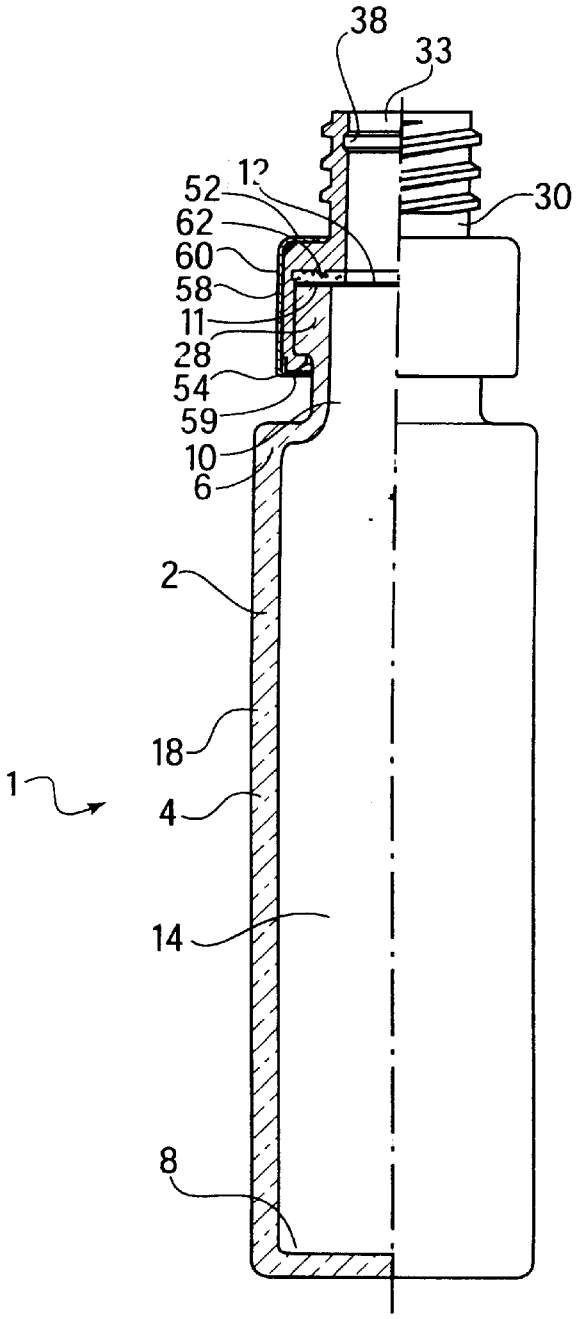
FIG. 2 is a side elevation and partial vertical section of the bottle with a neck assembly according to the present invention attached.
Figure 3:
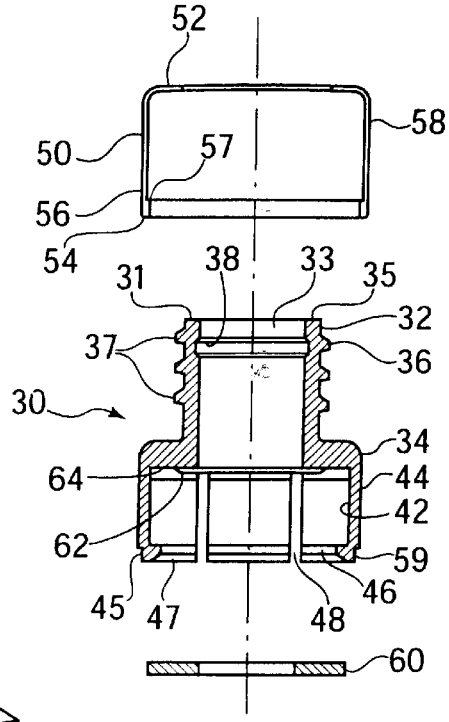
FIG. 3 is an exploded vertical section of the neck assembly showing the expansion slots and sealing ridge in greater detail.
Figure 4:
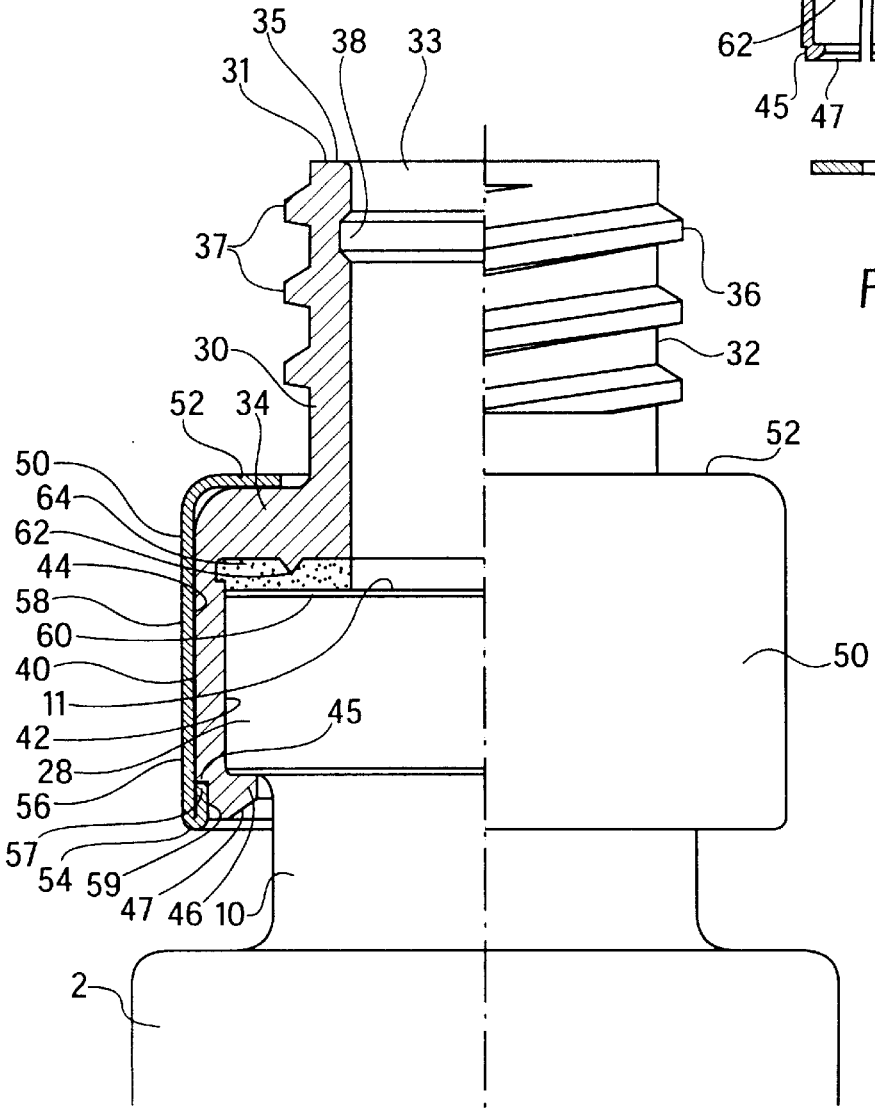
FIG. 4 is an enlarged partial vertical section showing the neck assembly on the neck of the bottle in greater detail.

Referring to FIGS. 1–3, a container 1 including a vial-like bottle 2 is shown which has a body 4 substantially defining an internal chamber 14 adapted to store a product, such as, for example, a cosmetic or pharmaceutical. It should be noted for the sake of clarity that all the components and parts of container 1 may not be shown and/or marked in all the drawings. As used in this description, the terms "up", "down", "top", "bottom", etc. refer to container 1 in the orientation illustrated in FIG. 2, for example, although it will be recognized that container 1 may be in any of various orientations when in use. Also, unless otherwise defined, the terms "inner" and "inwardly" indicate elements or surfaces directed toward or closer to a longitudinal axis of the container or bottle, and, conversely, the terms "outer" or "outwardly" indicate elements directed away from or further from the longitudinal axis.

The vial-like bottle 2 may be any one of a number of well known mass-produced metal or plastic bottles that have a downwardly directed annular shoulder proximal to an opening in one end. Particularly suitable are vial-like bottles having such a shoulder defined by an annular flange. The vial-like bottle may be made from a metal such as, for example, aluminum, steel, copper, brass or other alloys. The metal is formed into a bottle by any suitable metal forming method, e.g., stamping, deep-drawing, hydro-forming, bulging, roll-forming, sintering, casting, etc. The vial-like bottle may also be made from a plastic material different from or the same as the material of the neck assembly. If plastic, the vial-like bottle 2 may be made by any suitable plastic forming method, e.g., extrusion blow molding, injection molding, etc. The vial-like bottle may be made from plastics such as, for example, low density polyethylene (LDPE), polypropylene (PP), polyacetal (POM), Nylon, Santoprene (a TM of Monsanto Co., exclusively licensed to Advanced Elastomer Systems, L.P., for a thermoplastic elastomer) or polyvinyl chloride (PVC). It will be understood that other plastic materials may also be suitable. The bottle 2 is made by a method and from a plastic material selected primarily for its ability to facilitate mass-producing at the lowest possible unit cost containers having strength and resilience suitable for secure storage of products in shipping, warehousing, retailing and consumer use environs. The plastic material is also selected for its ability to be impermeable, chemically inert, stable and compatible with the product to be contained and with environment in which the container will be used. Similarly, the vial-like bottle 2 may be made from paper or wax by known methods.

The body 4 of bottle 2 has a vertical sidewall 18 connecting a top end 6 to a bottom end 8 to define an internal chamber 14. The bottom end 8 is generally a closed end. At the top end 6, a neck 10, alternatively referred to as a bottleneck, has a first end 7 connected to the bottle, and a second end 9. A longitudinal axis is defined through the first end 7 and second end 9 of the neck. An opening 12 is provided in the second end 9 for dispensing product from the internal chamber 14. The opening 12 is defined by a rim 11 formed by a peripheral wall 16. The peripheral wall 16 defining the opening 12 also defines a passage 17 that provides fluid communication between the internal chamber 14 and the opening 12. The neck 10 may have an external dimension that is narrower than an external dimension of the body 4 of the bottle 2. It will be understood however that this embodiment is merely illustrative, and that the peripheral wall 16 defining the opening 12 may be provided such that the external dimension of neck 10 is the same as or greater than that of the body 4.

The peripheral wall 16 of the neck 10 supports an annular flange 28 proximal to the opening 12. The flange 28 may alternatively be referred to as a "neck ring". In the preferred embodiment, the flange 28 is bounded on three sides by rim 11, an outwardly directed lateral side surface 24 and a downwardly directed bearing surface 22. A shoulder 20 is defined on the flange 28 by the intersection of lateral side surface 24 and bearing surface 22. Bearing surface 22 is generally directed away from the opening 12, and, at least to a minimal degree, directed downwardly toward the first end 7 of the neck 10. Although the intersection of the lateral side surface 24 and bearing surface 22 is shown as forming a relatively sharp edge 26, it will be understood that the edge 26 may be rounded to form a gradual transition from the lateral side surface to the bearing surface. The bearing surface may also have a curved surface (see, for example, 222 and 522 in FIGS. 7 and 10, respectively).

In the preferred embodiment, the shoulder 20 is an annular structure defined in part by the lower edge 26 of the flange 28. The shoulder can alternatively be defined by an upper edge of an annular groove about the neck 10 (see 120 and 220 in FIGS. 6 and 7, respectively). The shoulder 20 may be a continuous annular structure, or may be a discontinuous annularly arranged structure, i.e., a series of shoulder segments circumferentially spaced about the neck 10. In the preferred embodiment, the bottle 2 has a neck 10 with a single annular shoulder 20. However, it will be understood that the neck 10 may be provided with two or more vertically spaced annular shoulders.

Though well known and readily available, vial-like bottles generally do not have desirable closure engaging means, e.g., fine threads for engaging caps or other types of closure. As noted above, this is because the known bottles generally cannot be mass-produced at low cost with close dimensional tolerances, or detailed or sharp geometry, such as, for example, fine threads, shoulders or grooves. The present invention overcomes these shortcomings of the prior art by securely mounting a plastic neck member 30 in the form of an insert or extension to the known vial-like bottle 2 in a simple and low cost manner.

Referring now to FIGS. 1–4, the neck member 30 has a dispensing end 32 opposite a connecting end 34 aligned along a longitudinal axis that is coaxial to the longitudinal axis of the bottle neck 10. The dispensing end 32 defines a rim 31 leading to a passage 33 for dispensing the contents of the bottle from chamber 14. The dispensing passage 33 opens outwardly from the dispensing end 32, and is adapted at connecting end 34 to be in fluid communication with the chamber 14. The dispensing end 32 supports cap engaging means 36 in the form of, for example, screw threads 37. While screw threads are the preferred cap engaging means, it will be understood that the cap engaging means 36 could also take other forms (not shown), such as, for example, lugs and cams for a bayonet-type engagement, a bead or groove for receiving a snap cap, a frustoconical bevel for receiving a friction fit cap, etc. The neck member 30 is made from a plastic selected for an ability to be molded at low cost with a high degree of structural detail. Accordingly, the cap engaging means 36, e.g., threads 37, etc., can be molded to have finely detailed structure and have close tolerances suitable for an impermeable closure.

Figure 5:
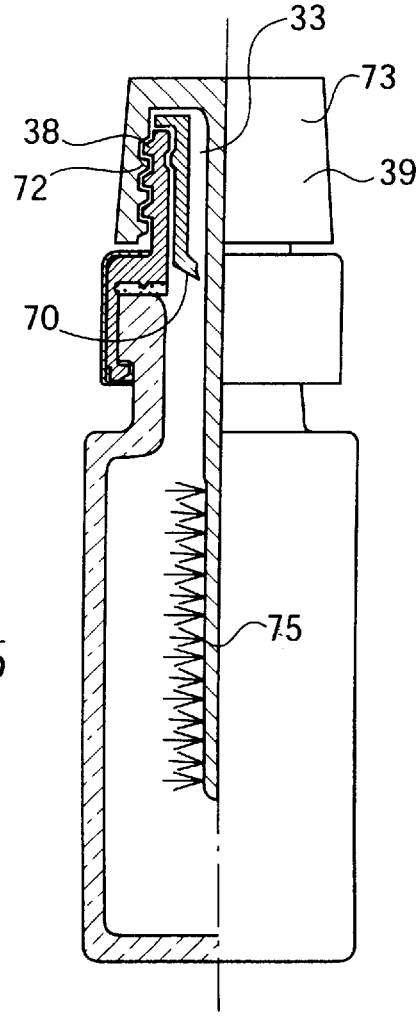
FIG. 5 is a vertical section of the bottle with the neck member, cap and brush combination, and wiper attached according to the present invention.

In use, the cap engaging means 36 support a cap 39 (see FIG. 5) in the form of, for example, a simple removable cap that may be selectively manipulated to open or close the dispensing passage 33. Alternatively, the cap 39 may comprise a cap supporting a dispenser (e.g., a pump, a dropper, etc., not shown), or a combination cap/handle 73 and applicator 75 (e.g., an applicator brush, see FIG. 5). Because the neck member 30 is made from a plastic selected for its ability to be molded with structural details, details can be provided to the completed package that are not typically found in low-cost mass-produced bottles.

For example, the dispensing end 32 may have cap engaging means such as screw threads molded on an outer surface of the neck member or on an inner surface of passage 33. In the preferred embodiment, passage 33 is dimensioned to receive a conventional wiper 70 (FIG. 5) in the form of an insert, and has an annular groove 38 molded in the inner surface of the passage 33. To secure the wiper insert in the passage 33, the groove 38 is adapted to receive in snap-fit engagement a bead 72 projecting outwardly from an outer surface of the wiper insert.

The neck member 30 is preferably made from one or more well known plastic materials, such as, for example, low density polyethylene (LDPE), polypropylene (PP), polyacetal (POM), Nylon, Santoprene (a trademark of Monsanto Co., exclusively licensed to Advanced Elastomer Systems, L.P., for a thermoplastic elastomer), polyvinyl chloride (PVC), acrylonitrile-butadiene-styrene (ABS), high density polyethylene (HDPE) or "SURLYN" (a registered trademark for an ionomer resin, described in product literature as an "ionically crosslinked" thermoplastic polymer derived from ethylene/methacrylic acid copolymers, commercially available from E. I. Du Pont de Nemours and Company, Inc., Wilmington, Del.). It will be understood that other plastic materials may also be suitable. The neck member 30 is made by a method and from a plastic material selected for its ability to be mass-produced at a low cost with precise tolerances and detailed or sharp geometry. The plastic material is also selected for its ability to be impermeable, chemically inert, stable and compatible with the product to be contained and with environment in which the container will be used. And the plastic material is selected to be sufficiently resilient to permit a ferrule 50 to pass over and engage a sleeve 40 in snap-fit engagement (discussed in greater detail below). The neck member is made by conventional means, such as, for example, by injection molding. Alternatively, a bi-injection process may be employed to make a neck member from a first plastic material with an integrally molded resilient sealing surface 35 on rim 31 made from the same or another plastic material.

The connecting end 34 includes a resilient portion in the form of a resilient sleeve 40 depending from the connecting end 34 and adapted to be received on the top end 6 of the bottle 2. The resilient sleeve 40 has an inner surface 42 and an outer surface 44. The outer surface 44 is the surface that is directed radially outwardly from the longitudinal axis. The inner surface 42 of the resilient sleeve 40 is that surface which faces a corresponding opposing surface of the bottle 2. In the preferred embodiment, inwardly directed inner surface 42 faces outwardly directed lateral side surface 24 of shoulder 20. The sleeve 40 of the connecting end 34 has an inner dimension defined by the inner surface 42 substantially corresponding to or slightly greater than the outer dimension of the flange 28. The inner surface 42 supports at least one inwardly directed protrusion 46. The protrusion 46 on the sleeve 40 is elastically biased inwardly to define an inner dimension smaller than the outer dimension of flange 28, and substantially corresponding to or slightly greater than an outer dimension of neck 10. In the preferred embodiment, the protrusion 46 is a substantially continuous annular structure corresponding circumferentially in position to the preferred continuous annular configuration of shoulder 20. The annular configuration of protrusion 46 is interrupted only by small slots or clearances 48 the purpose of which is explained in greater detail below. It will be understood that if the shoulder 20 is configured as circumferentially spaced segments, the protrusion 46 must have one or more portions that correspond in circumferential position to the spaced segments of the shoulder.

With the foregoing arrangement, the connecting end 34 including the resilient sleeve 40 and the protrusion 46 is dimensioned and provided with sufficient resilience to be closely received on the top end 6 of the bottle 2 in snap-fit engagement over shoulder 20. Accordingly, when the connecting end 34 of the neck member 30 is pushed onto the neck 10 of the bottle 2, the resilient sleeve 40 expands to permit the protrusion 46 to pass over the flange 28. Preferably, either an upper outer edge of the flange 28 or a lower inner edge 47 of the protrusion 46 is ramped to facilitate entry of the flange 28 into the sleeve 40. Once the protrusion 46 has passed over the flange 28, the resilient sleeve 40 returns substantially to its unexpanded state, forcing the protrusion toward the neck 10 below the flange 28. Removal of the neck member 30 from the bottle 2 is prevented by engagement of an upper surface 49 of the protrusion 46 with the opposing bearing surface 22 of the shoulder 20 as long as insufficient force is applied to overcome the inwardly directed bias of the resilient sleeve.

Slots or clearances 48 are provided in the sleeve 40 to enhance the ability of the sleeve 40 to expand outwardly to receive the flange 28 and retract inwardly to fit closely on the neck 10 of the bottle 2. The slots allow the resilient portion of the neck member to expand substantially to accommodate the flange of a bottle with relative ease, and to accommodate dimensional variations typically found in inexpensive vial-like bottles.

To lock the connecting end 34 of the neck member 30 securely to the bottle 2, a rigid annular retainer member is provided in the form of a ferrule 50. The ferrule 50 corresponds substantially in shape to the external shape of the connecting end 34 of the neck member 30. The ferrule 50 is dimensioned to fit closely on the resilient portion of the connecting end 34, i.e., on the sleeve 40. The ferrule is dimensioned and may be positioned anywhere on the sleeve 40 such that it prevents the sleeve 40 from expanding outwardly sufficiently to permit the protrusion 46 to pass up over the shoulder 20. In the preferred position, at least a portion of the ferrule is in radial alignment with the protrusion 46. To prevent expansion of the sleeve 40, the ferrule 50 has an inner dimension substantially corresponding to the external dimension of the sleeve 40. With the rigid ferrule 50 in position over the sleeve 40, the sleeve 40 is restrained from expanding outwardly. Because the sleeve 40 is restrained from expanding outwardly, the protrusion 46 is locked in position below the shoulder 20, thus preventing the neck member 30 from pulling free of the bottle. In any case, when the ferrule 50 is fixedly positioned on the connecting end 34 by press-fit or snap fit, the neck member 30 is securely mounted on the bottle 2.

To enhance the ability of the ferrule 50 to lock the neck member 30 to the bottle 2, the ferrule 50 is provided with an upwardly directed edge 57. The upwardly directed edge 57 may take the form of an upper edge of the ferrule 50 (see FIG. 8). Preferably, the upwardly directed edge 57 is provided to the ferrule 50 by rolling a lower edge 54 inwardly and upwardly. In other words, the lower edge 54 of the wall 56 of the ferrule is folded back on itself. In addition to providing an upwardly directed edge 57 inside the ferrule 50, this arrangement provides an attractive 'rolled' lower rim to the ferrule 50 that is free of sharp edges that could cause discomfort or injury to the user.

The upwardly directed edge 57 of the ferrule 50 engages a corresponding downwardly directed edge 45 on the sleeve 40. The downwardly directed edge 45 is defined by an annular undercut in the outer surface 44 of the sleeve 40. The downwardly directed edge 45 may merely be the lower edge of the sleeve (see FIG. 7). Preferably, the downwardly directed edge 45 is formed as part of an annular clearance 59 in the outer surface 44 of the sleeve 40.

To securely retain the resilient sleeve 40 of the neck member 30 on the bottle 2, the ferrule 50 is made from a relatively rigid material such as metal. Preferably the ferrule 50 is made of aluminum. Other relatively rigid materials may also be suitable for making the ferrule 50, such as, for example, rigid plastic, etc. The ferrule may consist of a simple ring-like or sleeve-like shape (see 350, 450 in FIGS. 8–9, respectively) having a peripheral wall 358, 458 only. Alternatively, the ferrule 50 may have a cup-like shape (see FIGS. 1–2, 4–7 and 10) defined by a peripheral wall 58, 558 and an annular end wall 52, 552, respectively.

The container is assembled by snap-fitting the neck member 30 onto the neck 10 of the bottle 2. In other words, the sleeve 40 is pressed onto the neck 10 until the protrusion 46 is below the flange of the neck, i.e., the protrusion 46 is positioned in the reduced diameter portion of the neck 10. Subsequent to fitting the neck member 30 onto the neck 10 of the bottle 2, the ferrule 50 is press fit onto the outer surface 44 of the sleeve 40. The ferrule is advanced over the sleeve 40 until the upwardly directed edge 57 of the ferrule 50 engages the downwardly directed edge 45 of the sleeve 40. This locks the ferrule onto the sleeve.

At least one annular seal 60 may be provided at the connection between the bottle 2 and the neck member 30 to prevent the escape of product from the container and to prevent the entry of air or contaminant into the container through the connection. As shown in FIGS. 1–5, the seal 60 may be an individual component, i.e., a separate O-ring or washer captured between a surface 64 on neck member 30 and the opposing surface of rim 11 on bottle 2. To improve the effect of the seal 60, the connecting end 34 and the ferrule 50 are adapted in dimension and structure to engage the top end 6 of the bottle such that downwardly directed surface 64 of the connecting end is drawn toward upwardly directed rim 11 of the bottle opening. This is accomplished in part by spacing the protrusion 46 from the surface 64 a distance that corresponds substantially to the dimension of the flange 28 along the longitudinal axis of the container. The end wall 52 of the ferrule 50 is also adapted to contribute to drawing the surface 64 toward the rim 11. In this way, the resilient material of seal 60 is securely captured and pinched between surface 64 of the neck member and rim 11 of the bottle 2 to form an impermeable barrier. To enhance the effectiveness of the seal formed between surface 64 on the neck member 30 and the rim 11 of the bottle, an annular bead or ridge 62 is provided on the surface 64.

As an alternative to an individual component seal, the seal 60 may comprise a part of a composite structure in the form of a washer-like sealing surface that is molded (e.g., by bi-injection molding), adhered or otherwise fastened to surface 64 on the neck member 30 before the neck member is mounted on the bottle 2.

The seal 60 is made from rubber, elastomer or other resilient type material, and may be foamed to improve its resiliency and sealing characteristics. In the case of either an individual component seal or a molded sealing surface provided on the neck member, the seal 60 may be made, for example, from a material such as silicone, Santoprene, Kraton or low density polyethylene (LDPE).

For ease in manufacture, simplicity in structure, durability and longevity, the at least one seal 60 is preferably positioned between the neck member 30 and the bottle 2. As noted above, the seal is preferably positioned between the rim 11 of the bottle 2 and an annular surface 64 on the neck member that faces the rim 11. However, it will be understood that the at least one seal 60, or additional seals (not shown) may be provided between any opposing surfaces of the bottle 2 and the neck member 30, respectively. For example, an O-ring type seal may be provided between the side surface 24 of the shoulder 20 and the inner surface 42 of the resilient sleeve 40 of the neck member. Alternatively, the seal could comprise an internal or external element, such as, for example, a membrane bridging the gap between the neck member and the bottle to form an impermeable barrier connecting the neck member and the bottle.

In another alternative embodiment the wiper 70 may be integrally molded, or bi-injection molded as an integral part of either the neck member 30 or the seal 60. Alternatively, the neck member 30, seal 60 and wiper 70 may be integrally molded or bi-injection molded as a single unit adapted to be snap-fit onto a standard vial-like metal or plastic bottle, and locked into place with the ferrule 50.

Figure 6:
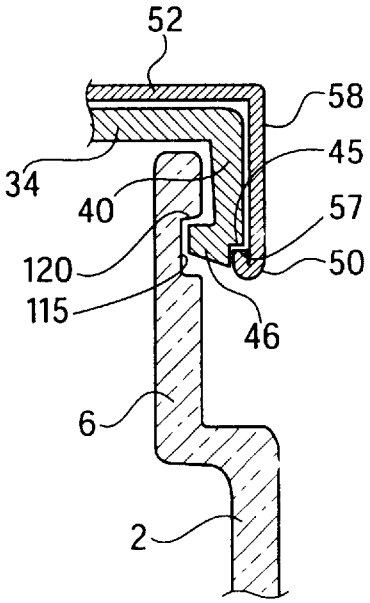
FIGS. 6–10 are representative partial vertical sectional views showing alternative embodiments of the shoulder and protrusion according to the invention.
Figure 7:
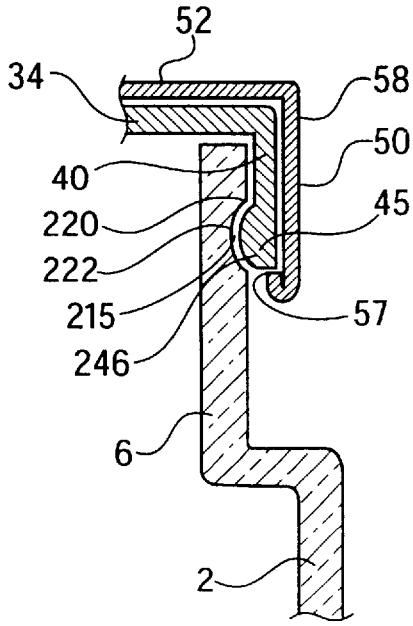
Figure 8:
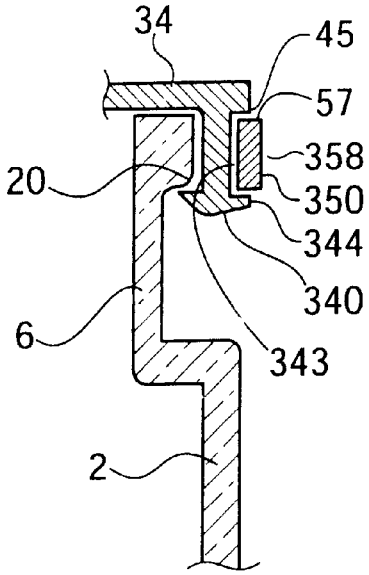
Figure 9:
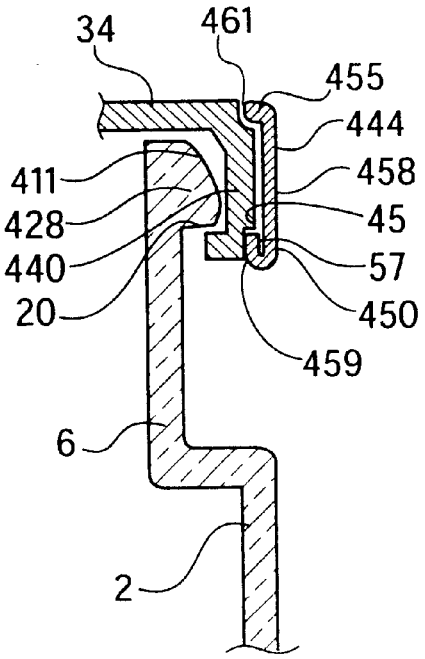
Figure 10:
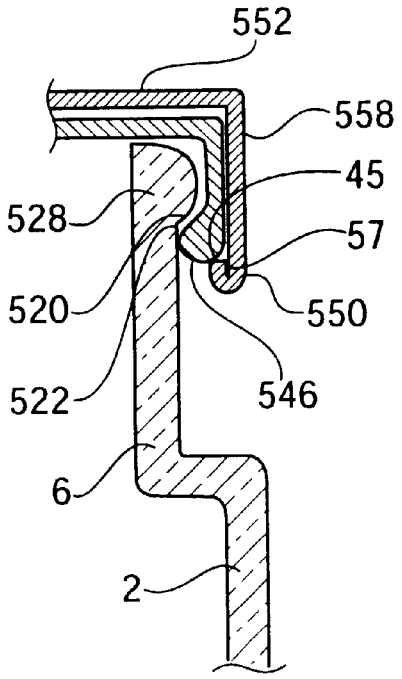

FIGS. 6–10 are representative partial vertical sectional views showing alternative embodiments of the connecting end 34 of the neck member 30 and top end 6 of the bottle 2. In FIGS. 6 and 7 the ferrule 50 is substantially the same as that in the embodiment shown in FIGS. 1–5. FIG. 6 shows a shoulder 120 formed as a top edge of a groove 115 with an angular cross-section, and a protrusion 46 substantially similar to that in the preferred embodiment. FIG. 7 shows a shoulder 220 formed as a top edge of a groove 215 with a semi-circular cross-section, and a protrusion 246 with a semi-circular cross-section corresponding to that of the groove 215. In FIG. 8, the shoulder 20 and protrusion 46 are substantially similar to the shoulder and protrusion described in the preferred embodiment, but the ferrule 350 is sleeve-like, and is received in a groove 343 on an outer surface 344 of the sleeve 340. The upper edge of the ferrule 350 is the upwardly directed edge 57 which engages a downwardly directed edge 45 (the upper edge of groove 343) of the sleeve 340. In FIG. 9, the ferrule 450 is sleeve-like, with opposite edges 454, 455 rolled or folded back to form spaced apart reduced diameter portions. The reduced diameter portions are received in corresponding grooves 459, 461 on the outer surface 444 of the sleeve 440. The upper edge of groove 459 serves as the downwardly directed edge 45 of the sleeve 440, which engages an upwardly directed edge 57 of the lower edge of ferrule 450. FIG. 9 also shows a bottle rim 411 that is ramped to facilitate entry of the flange 428 into the sleeve 440. Because the rim 411 is ramped, the protrusion 446 need not be. FIG. 10 shows a flange 528, a shoulder 520 and a protrusion 546, each with a rounded cross-section. The intersection of the side wall 558 and end wall 552 of the ferrule 550 is similarly rounded. It will be understood from these representative views that numerous combinations and variations are possible with respect to the structure connecting the neck member to the bottle.

While the preferred embodiments of the present invention have been described, it will be understood by those skilled in the art that various changes and modifications may be made without departing from the spirit and scope of the invention as set forth in the following claims.

What is claimed is:

1. A container comprising:

a bottle defining an internal chamber and having a neck with a first end connected to the bottle and a second end defining an opening, a longitudinal axis of the neck defined through the first end and second end, a first passage through the neck providing fluid communication between the opening and the internal chamber, a shoulder extending radially from an outer surface of the neck adjacent to the opening, the shoulder defined by an intersection of a first surface directed radially outwardly from the longitudinal axis and a second surface directed generally toward the first end of the neck, the shoulder defining a first radial dimension;

a neck member having a dispensing end and a connecting end, a second passage providing fluid communication between the dispensing end and the connecting end, the second passage opening outwardly at the dispensing end and in fluid communication with the opening in the neck of the bottle at the connecting end, the dispensing end supporting means for selectively engaging a closure, a sleeve depending from the connecting end and received on the second end of the neck, the sleeve biased toward an inside dimension closely approximating the first radial dimension of the shoulder, a lower portion of the sleeve supporting at least one inwardly directed protrusion defining a second radial dimension smaller than the first radial dimension of the shoulder, the sleeve adapted to expand against the bias such that the at least one protrusion is movable from the second radial dimension to the first radial dimension to permit installation of the neck member on the neck, and an annular undercut in an outer surface of the sleeve defining a downwardly directed edge; and a ferrule having a cylindrical portion dimensioned to fit closely about an outer surface of the sleeve when the at least one protrusion is at the second radial dimension such that the sleeve is restrained from expanding and the at least one protrusion is prevented from moving from the second radial dimension to the first radial dimension, the ferrule having at least one upwardly directed edge adapted to engage the downwardly directed edge of the sleeve to lock the ferrule on the sleeve.

2. The container of claim 1 wherein a lower edge of the sleeve defines the undercut.

3. The container of claim 1 wherein an annular clearance in the outer surface of the sleeve defines the undercut.

4. The container of claim 1 wherein the upper edge of the ferrule defines the upwardly directed edge.

5. The container of claim 1 wherein the ferrule is metal.

6. The container of claim 4 wherein the upwardly directed edge is defined by a lower edge of the metal ferrule that is rolled inwardly and upwardly.

7. The container of claim 1 further comprising a seal positioned between opposing surfaces of the neck member and the neck.

8. The container of claim 1 wherein the seal is made from an elastomeric material.

9. The container of claim 1 wherein the ferrule has an inwardly extending annular end wall.

10. The container of claim 1 wherein the means for selectively closing the passage comprises a screw thread adapted to receive a cooperatively threaded cap.

11. The container of claim 1 further comprising a wiper connected to one of the neck member or the seal.

12. The container of claim 7 wherein the wiper is integrally formed with at least one of the neck member or the seal.

13. The container of claim 1 wherein the bottle is made from a material selected from at least one of aluminum, steel, copper, brass, plastic, paper or wax.

14. The container of claim 13 where in the plastic is selected from one of LDPE, PP, POM, Nylon, Santoprene and PVC.

15. A neck assembly for mounting on a neck of a vial-like bottle defining an internal chamber, the neck having a first end connected to the bottle and a second end defining an opening, a longitudinal axis of the neck defined through the first end and second end, a first passage through the neck providing fluid communication between the opening and the internal chamber, a shoulder extending radially from an outer surface of the neck adjacent to the opening, the shoulder defined by an intersection of a first surface directed radially outwardly from the longitudinal axis and a second surface directed generally toward the first end, the shoulder defining a first radial dimension, the neck assembly comprising:

a neck member having a dispensing end and a connecting end, a second passage providing fluid communication between the dispensing end and the connecting end, the second passage opening outwardly at the dispensing end and in fluid communication with the opening in the neck of the bottle at the connecting end, the dispensing end supporting means for selectively engaging a closure, a sleeve depending from the connecting end and received on the second end of the neck, the sleeve biased toward an inside dimension closely approximating the first radial dimension of the shoulder, a lower portion of the sleeve supporting at least one inwardly directed protrusion defining a second radial dimension smaller than the first radial dimension of the shoulder, the sleeve adapted to expand against the bias such that the at least one protrusion is movable from the second radial dimension to the first radial dimension to permit installation of the neck member on the neck, and an annular undercut in an outer surface of the sleeve defining a downwardly directed edge; and a ferrule adapted to be installed on the sleeve after the neck member is installed on the neck, the ferrule having a cylindrical portion dimensioned to fit closely about an outer surface of the sleeve when the at least one protrusion is at the second radial dimension such that the sleeve is restrained from expanding and the at least one protrusion is prevented from moving from the second radial dimension to the first radial dimension, the ferrule having at least one upwardly directed edge adapted to engage the downwardly directed edge of the sleeve to lock the ferrule on the sleeve.

16. The neck assembly of claim 15 wherein a lower edge of the sleeve defines the undercut.

17. The neck assembly of claim 15 wherein an annular clearance in the outer surface of the sleeve defines the undercut.

18. The neck assembly of claim 15 wherein the upper edge of the ferrule defines the upwardly directed edge.

19. The neck assembly of claim 15 wherein the ferrule is metal.

20. The neck assembly of claim 19 wherein the upwardly directed edge is defined by a lower edge of the metal ferrule that is rolled inwardly and upwardly.

21. The neck assembly of claim 15 further comprising a seal adapted to be positioned between opposing surfaces of the neck member and the neck.

22. The neck assembly of claim 21 wherein the seal is made from an elastomeric material.

23. The neck assembly of claim 15 wherein the ferrule has an inwardly extending annular end wall.

24. The neck assembly of claim 15 wherein the means for selectively closing the passage comprises a screw thread adapted to receive a cooperatively threaded cap.

25. The neck assembly of claim 15 further comprising a wiper connected to one of the neck member or the seal.

26. The neck assembly of claim 15 wherein the wiper is integrally formed with at least one of the neck member or the seal.

27. Method for making an airtight container from a metal or plastic bottle having an upwardly opening neck, an annular flange on the neck defining a first radial dimension and defining a reduced diameter portion of the neck, the method comprising:

providing a plastic neck insert having a threaded neck opposite a downwardly directed resilient sleeve, the resilient sleeve having an upper portion dimensioned to receive the annular flange and a lower portion with an inwardly directed protrusion defining a second dimension smaller than the first dimension, the resilient sleeve biased to direct the protrusion toward the second dimension and expandable to accommodate passage of the protrusion over the flange, the sleeve having an annular undercut in an outer surface of the sleeve defining a downwardly directed edge;

inserting the neck with the flange into the resilient sleeve sufficiently to place the protrusion adjacent the reduced diameter portion of the neck;

providing a ferrule with a radial dimension selected to closely fit the resilient sleeve such that expansion of the resilient sleeve is restricted sufficiently to prevent release of the sleeve from the flange, the ferrule having an upwardly directed edge; and press-fitting the ferrule about the outer surface of the resilient sleeve until the upwardly directed edge of the ferrule engages the downwardly directed edge of the sleeve.

* * * * *